US007608000B2

(12) United States Patent
Butler

(10) Patent No.: US 7,608,000 B2
(45) Date of Patent: Oct. 27, 2009

(54) SYSTEM FOR PLAYING A GAME

(76) Inventor: Bradley A. Butler, 4754 W. Folley St., Chandler, AZ (US) 85226

( * ) Notice: Subject to any disclaimer, the term of this patent is extended or adjusted under 35 U.S.C. 154(b) by 0 days.

(21) Appl. No.: 12/025,169

(22) Filed: Feb. 4, 2008

(65) Prior Publication Data

US 2008/0125252 A1 May 29, 2008

Related U.S. Application Data

(63) Continuation of application No. 11/215,848, filed on Aug. 30, 2005, now abandoned.

(51) Int. Cl.
*A63B 67/00* (2006.01)

(52) U.S. Cl. ..... 473/415; 473/422; 473/456; 473/473

(58) Field of Classification Search ..... 473/415, 473/422, 421, 465, 473
See application file for complete search history.

(56) References Cited

U.S. PATENT DOCUMENTS

| | | | | | |
|---|---|---|---|---|---|
| 1,556,046 | A | * | 10/1925 | Taylor | 473/473 |
| 2,823,034 | A | * | 2/1958 | Bingham, Jr. | 473/421 |
| 4,146,225 | A | * | 3/1979 | Hallett et al. | 473/465 |
| 4,368,892 | A | * | 1/1983 | White | 473/473 |
| 4,569,515 | A | * | 2/1986 | Gordon | 473/473 |
| 4,718,668 | A | * | 1/1988 | Schipske | 473/462 |
| D330,741 | S | * | 11/1992 | Matsch | D21/826 |
| D330,744 | S | * | 11/1992 | Matsch | D21/821 |
| 5,259,625 | A | * | 11/1993 | Fanning | 473/473 |
| D343,670 | S | * | 1/1994 | Petersheim | D21/826 |
| D344,317 | S | * | 2/1994 | Petersheim | D21/821 |
| D370,045 | S | * | 5/1996 | Derbecker | D21/826 |
| 5,634,638 | A | * | 6/1997 | Havens et al. | 473/421 |
| 5,636,834 | A | * | 6/1997 | Horkan | 473/445 |
| 5,681,168 | A | * | 10/1997 | Brown | 434/219 |
| 6,216,717 | B1 | * | 4/2001 | Chen | 135/130 |
| 6,223,358 | B1 | * | 5/2001 | DePietro | 4/498 |
| 6,348,028 | B1 | * | 2/2002 | Cragg | 482/148 |
| 2006/0191564 | A1 | * | 8/2006 | Connelly | 135/121 |

FOREIGN PATENT DOCUMENTS

| | | | | |
|---|---|---|---|---|
| FR | 2349298 | A | * | 12/1977 |
| GB | 2105385 | A | * | 3/1983 |

* cited by examiner

*Primary Examiner*—Mitra Aryanpour
(74) *Attorney, Agent, or Firm*—Bradley K. DeSandro; Quarles & Brady LLP

(57) ABSTRACT

A multiplayer game, having rules with aspects of the games of Four Square and Volleyball, is played with an apparatus that can optionally be respectively disassembled and set up.

12 Claims, 7 Drawing Sheets

SYSTEM FOR PLAYING A GAME

RELATED APPLICATIONS

This is a continuation of U.S. patent application Ser. No. 11/215,848, filed one Aug. 30, 2005, titled Method and Apparatus For Playing A Game With a Projectile, which is incorporated herein by reference.

BACKGROUND

1. Field of the Invention

The present invention relates to method and apparatus for playing a ball game. More specifically, the present invention provides for an apparatus that enables players to engage in a fast-paced game that combines aspects of the games of volleyball and foursquare while providing a game frame that is portable and deployable in a variety of environments.

2. Description of the Related Art

There are several prior art variations of the traditional playground game of Four Square, but they share many of the same characteristics. Typically, the game is played with an elastic ball such as a rubber playground ball on a solid ground surface such as a concrete or asphalt playground or parking area. Referring to a top view of the prior art game square arrangement shown in FIG. 1A, a large square (10) is marked on a solid horizontal surface with a permanent medium such as paint, or with a temporary marking medium such as chalk. The large square (10) is approximately sixteen feet on each side (20) (or may be larger or smaller based on the skill of the players involved), and is further equally divided with orthogonal markings into four square interior play areas (A, B, C, and D).

Referring to FIG. 1A. and FIG. 1B, to begin play, four players (60) enter the large square (10) and each individual player (60) stands in one of the four interior play areas (A, B, C, or D). The player in interior square (or in the alternative, "box") "D" is designated as the "server," and places a foot in the small "service box" (40) within box D (or alternatively places a foot on the corner of the large square (10) nearest to the service box (40)) and begins a rally by hitting the ball (50) by hand into any one of the other boxes (A, B, or C). Optionally, game rules may require the server to allow the ball (50) bounce once in the server's box (D) before it is struck by hand to enter another internal play box (A, B, or C), and in one variation, the ball must be served into the box diagonally opposite (B) of the server's box (D).

Once the served, the ball enters one of the other internal play boxes (A, B, or C). It is allowed to bounce once, and then the player within the box that received the serve must strike the ball by hand, returning the ball so that it may bounce within another interior box before the ball bounces again. In one version of the game, a receiving player may hit the ball to another interior box before the ball bounces in that player's play box. The rally continues by players striking and returning the ball to other internal play boxes until a player is unable to successfully return the ball to bounce within another player's box.

The player that is unable to correctly return the ball to another square is considered "out," and leaves the game square (10), optionally moving to the end of a queue of waiting players (30). If the server was not the "out" player, the server then receives one point toward that player's individual score, with an overall goal of remaining as server and accruing points as long as possible. After the "out" player leaves the game square (10), players rotate counterclockwise (from A to D) to fill in the gap of the missing "out" player, and then a new player enters into box A from the front of the player queue (30). In this arrangement, play continues indefinitely with players rotating through the game as players go "out," and additional players may join by simply joining the end of the player queue (30).

Referring to FIG. 2, a court (200) for the classic game of volleyball is shown. Volleyball may be played in areas such as grassy lawns and beaches, since the game does not require a ball to bounce from a solid surface. However, the game requires that a net (220) be erected in a manner that prevents it from falling over after being touched, impact from ball strikes, or from natural events such as wind. Further, the outside boundaries of the volleyball court (210) must be clearly demarked to assist in determining when a ball that hits ground was within the boundary or out of bounds. Yet in play areas such as sandy beaches, court boundaries (210) can be difficult to create in a manner that resists scuffing, player footsteps, and ball strikes. The erection of a temporary volleyball court on a soft play surface therefore presents challenges to that delay players' abilities to ability to quickly begin a game, and once the game is begun, boundaries (210) may have to be periodically redrawn.

What is needed, then, is a game that combines the excitement of volleyball with the rapid and fun game of four square. What is also needed is an apparatus that can be erected in a variety of playing environments without extended set up time. What is further needed is a gaming apparatus that is easily portable and breaks down to a size that lends itself to easy transportation and storage. What is further needed is a mechanism to create a foursquare-like game play area such as a beach or grass lawn that does not require a hard, completely flat surface with scuff-resistant edge indicia. What is further needed is an exciting, fast-paced interactive game that combines aspects of foursquare and volleyball, allowing for play on either hard or soft playing surfaces.

SUMMARY

In view of the foregoing, it is an object of the present invention to improve various problems associated with the prior art. More specifically, it is an object of the present invention to provide a portable game apparatus that enables players to perform a method of game play that combines aspects of volleyball and foursquare into a fun, exciting, multi-layer game. To that end, the method and apparatus of the present invention provides a Four Square-like game that is played in the air above players' heads. By providing for a portable, elevated game frame, player squares that are provided on a hard ground surface in Four Square are now elevated above the players' heads, and a player now uses volleyball-like ball strikes to hit the ball up and out of the players' game square and into another player's game square. Alternatively, the present invention may be viewed as a 4-way volleyball game without the need for nets or markings on the ground.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed. Thus, the present invention comprises a combination of features, steps, and advantages which enable it to overcome various deficiencies of the prior art. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of a preferred embodiment of the present invention, reference will now be made to the accompanying drawings, which form a part of the specification, and wherein.

DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

Figure 1A:
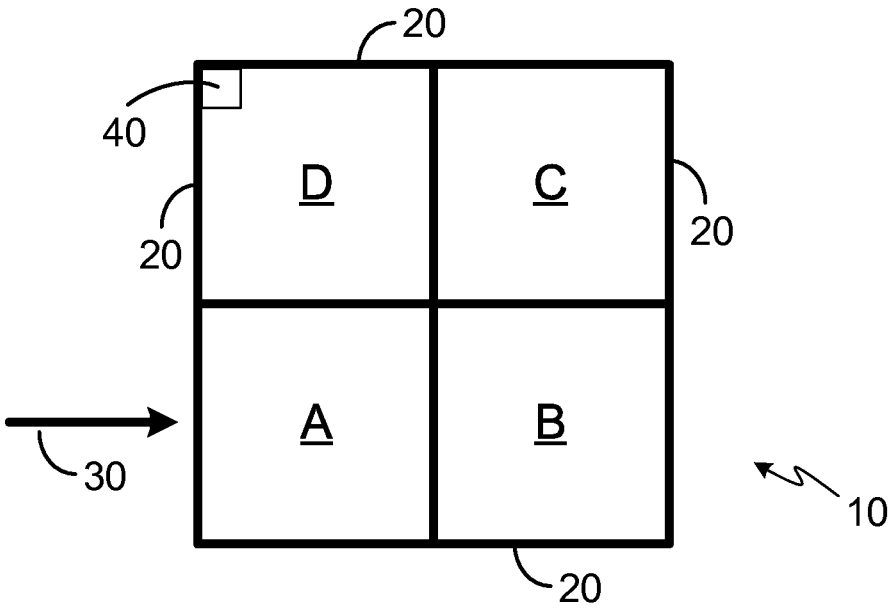
FIG. 1A PRIOR ART
FIG. 1A depicts a plan view of a prior art Four Square game layout.
Figure 1B:
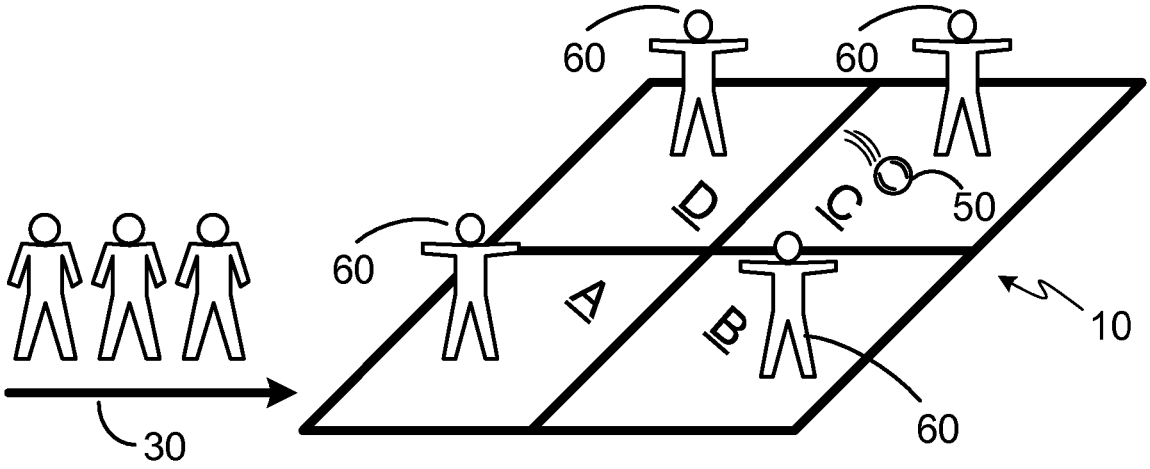
FIG. 1B PRIOR ART
FIG. 1B illustrates a view of a prior art Four Square game with players engaged in a rally.
Figure 2:
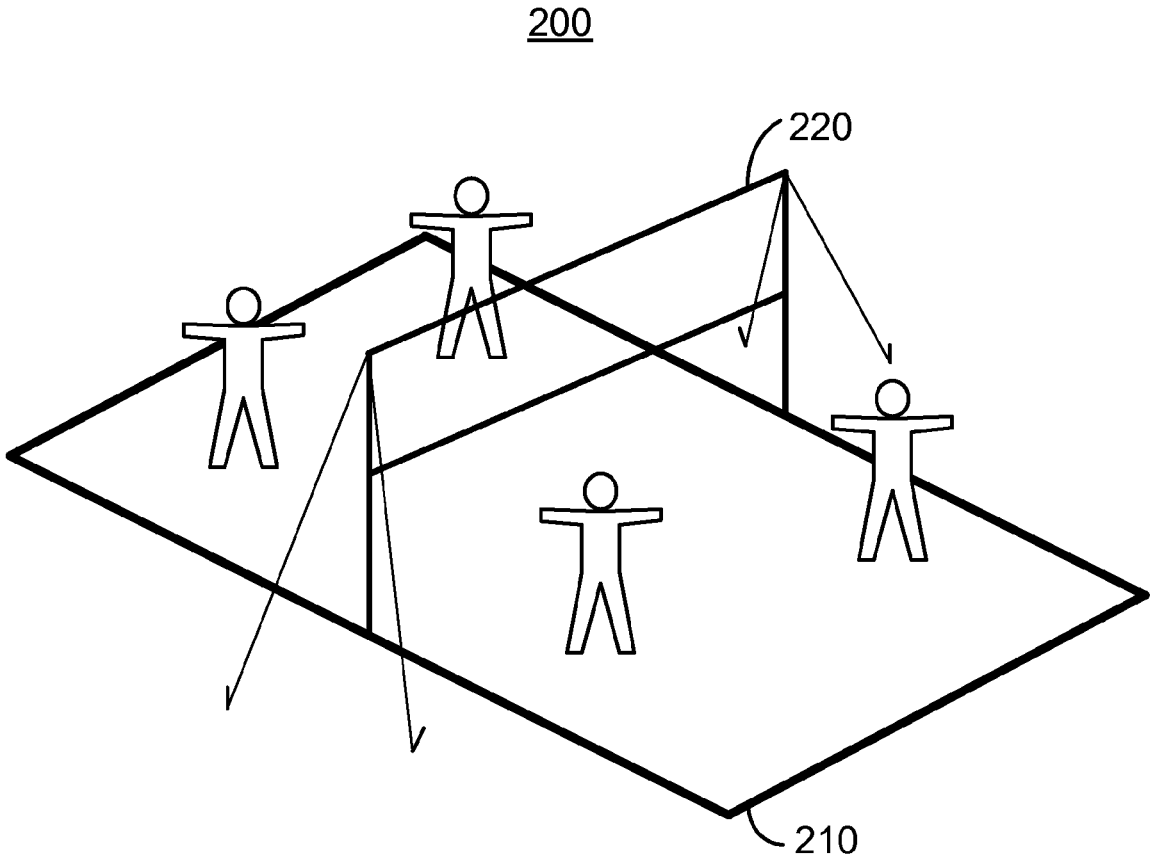
FIG. 2 PRIOR ART
FIG. 2 illustrates a view of a prior art volleyball court.
Figure 3:
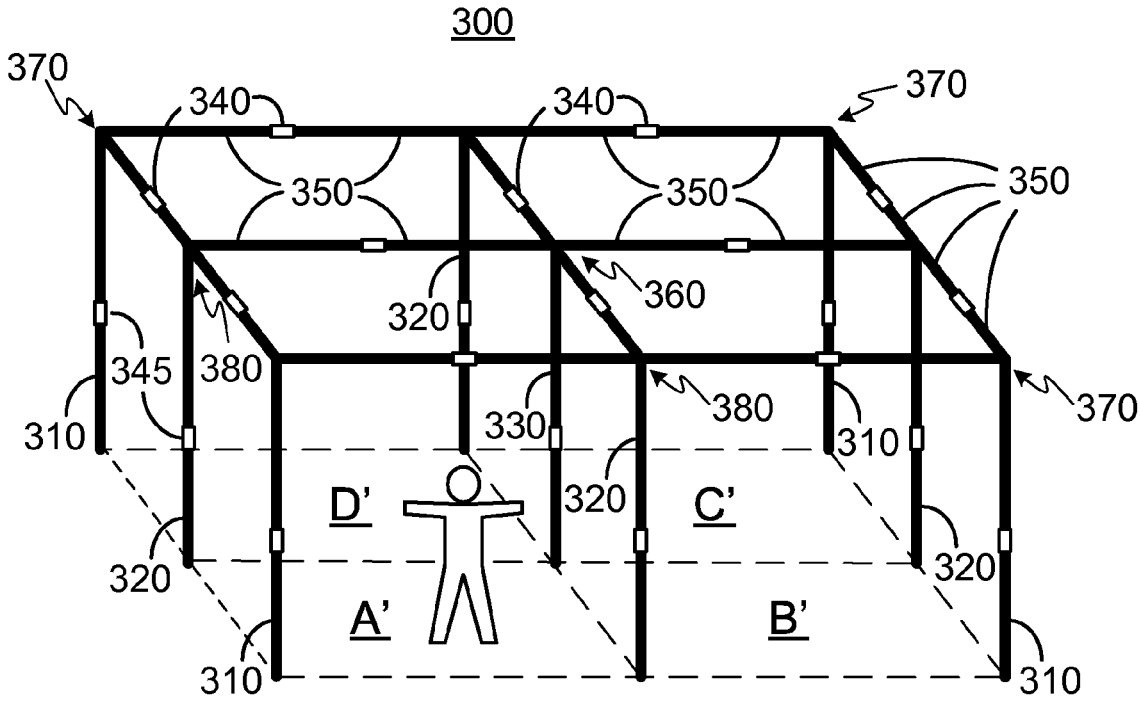
FIG. 3 illustrates one embodiment of the game frame apparatus of the present invention.

FIG. 3 illustrates an overall conceptual view of one embodiment of the apparatus of the present invention, herein also referred to as the "game frame" (300). In one embodiment, the game frame (300) can be used as a game apparatus to play a game in which a projectile is projected among players. It is understood by those of skill in the art that such projectiles may constitute any number of objects that are adapted to play a game, such as a ball, a shuttlecock or "birdie," a balloon, a beanbag, a or self-illuminated object. The game apparatus has at least three substantially equal volumes. Each volume is contiguous with each other volume and is sized sufficiently to be occupied by at least one player. Each volume is also bounded or otherwise defined by a plurality of elongate members that are above a playing surface. By way of example, and not by way of limitation, each or some of the elongate members can be a pole. At least some of the elongate members are positioned above the heads of the players. In the game, players project the projectile over the elongate members that are above the heads of the players. In one embodiment, the game apparatus also has means for connecting each elongate member so as to be substantially normal to at least one other elongate member. Also, the game apparatus has means, for at least some of the elongate members, for adjusting the length of the elongate member. Each elongate member can be made of aluminum, steel, PVC, polystyrene, polyethylene, nylon, or combinations thereof.

Each said volume has a three dimensional (3D) shape. The 3D shape is defined by the linear movement of a 2D object, such as a rectangle, a circle, an octagon, a triangle, or a polygon. Thus, a linearly moved square (2D) forms a volume that is a cube (3D).

The adjustment means can be one or more joints for moving the elongate member between an open and a closed position thereof. The closed position, for instance can be a pole that is folded in half. The joint can be hinge or a bending member formed in the middle of the pole. The adjustment means can be capable of allowing the pole to be disassembled. Also, when the pole is made up of substantially concentric pole, the adjusting means can be for telescoping an inner pole within an outer pole.

For each volume, the connecting means and adjusting means respectively articulate to collapse the volume such that the plurality of elongate members thereof are parallel one to another. Also, the connecting means and adjusting means respectively articulate such that the plurality of elongate members can be moved into an operative position in which each elongate member is substantially normal to at least one other said elongate member, and a collapsed position in which each said elongate member is substantially parallel to each other said elongate member. Examples of the foregoing, for one embodiment, are seen in FIGS. 7-10.

Each volume will preferably have a width and height suitable for the players. For instance, adults would prefer a width not less than four feet and a height not less than six feet.

In yet another embodiment, the game frame (300) is comprised of horizontal bar members (350) substantially parallel to a ground or play surface interconnected to form an orthogonally-bisected square defining the top of four interior play boxes (A', B', C', and D') with one connection point (360) common to all four interior play boxes (A', B', C', and D').

The twice bisected square that defines the top of the game frame (300) is supported above the ground or play surface by four vertical corner poles (310), four mid-poles (320), and a center pole (330). The poles, together with the bar members and the bottom play surface, define a polyhedron-like shape, which further comprises the interior polyhedron volumes or play boxes (A', B', C', and D') that are occupied by players. The volumes defined by the interior play boxes (A', B', C', and D') may be contiguous or substantially contiguous, and one player is intended to occupy each volume. Each top side of an interior play box (A', B', C', and D') is comprised of two substantially horizontal bar members (350) hingedly or detachably connected at their midpoints by articulation points (340) comprised in one embodiment of locking bar hinges. In alternate embodiments, the articulation points are comprised of flexible bending points, friction-fit connections, double pin hinges, or snap-fit connections. In an alternate embodiment, each top side (A', B', C', and D') of the interior play boxes is not defined by two hingedly interconnected bar members, but a single rigid bar member, and in additional embodiments, the bar members (350) may further comprise two or more articulation points (350) for enhanced disassembly. The bar members (350) that do not reside on the outside edge of the game frame (300) not only serve to add structural integrity to the game frame (300) but also provide a barrier over which a projectile (30) (for instance, a ball, a birdie, or another object) must pass during play, much as a volleyball must pass over a net. The projectile may be projected by a player simply by throwing, kicking, punching, or hitting it, or by a player hitting the projective by a bat, a racket, a stick, a paddle, or another instrument. Preferably, the projectile is a ball that is manually projected by the players among themselves over the barrier and into each respective player's play box or volume.

Each interior play box is further comprised of one outside corner (370), two mid-corner connections (380) and a common connection (360) to the center pole (330). While in one embodiment the poles (310, 320, 330) may be rigid and incapable of folding, in an alternate embodiment, the poles (310, 320, 330) further comprise a take-down element (345) whereby the poles may be shortened in length through a flexible bending point, a locking hinge-fold mechanism, or through a concentric inner pole element telescoping from a hollow outer element of the pole. While bar members (350) may be permanently connected to poles (310, 320, 330), in one embodiment, bar members (350) are attached to the poles (310, 320, 330) through a friction fit socket, or in another embodiment, bar members (350) attach at outside corners (370), central T-junctions (380) and the central four-way junction (360) through hingedly-movable connections. Take-down and disassembly of the game frame is discussed in more detail below.

In one embodiment, poles (310, 320, 330) and bar members (350) may be manufactured from tubular steel, aluminum, PVC, polystyrene, polyethylene, nylon or any substance that is sufficiently lightweight to be person-portable yet rigid enough to be self-supporting and resistant to bend forces induced by ball or player strikes. In an alternate embodiment, poles (310, 320, 330) and bar members (350) may be manufactured from transparent material, wherein light strings such as miniature Christmas-type bulbs or LED lights are contained within the poles and bar members to light the structure and alternatively to provide ambient light for night-time play or decoration. Alternatively, the poles and bar member may be manufactured from either semi-transparent or partially transparent material, and string lights are molded into a channel within each frame member. In another embodiment, poles and bar members further comprise channels substantially aligned with the central axis of the poles and bar members, wherein LED lights and wiring strings are retained within the channel by a friction fit, a set of clamps, or conventional adhesives. In an alternate embodiment, the lighting system further comprises an electronic control unit that provides a pulsed signal to the lights, so that various patterns of flashing and/or multicolor display may be achieved, such as provided by prior art synchronous Christmas "chaser" lights.

Figure 5:
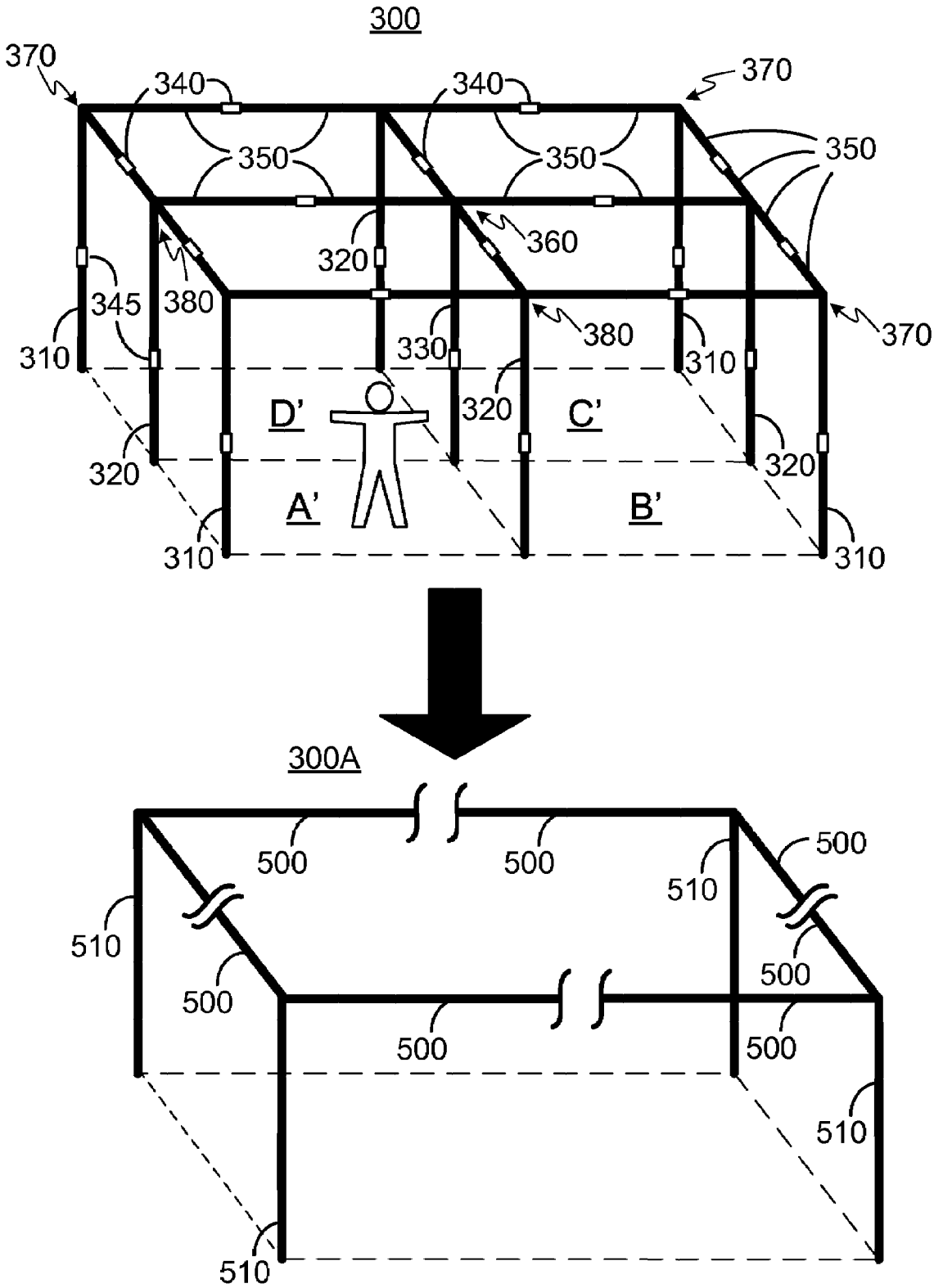
FIG. 5 illustrates correspondence with alternative embodiments of the game frame apparatus of the present invention.
Figure 6:
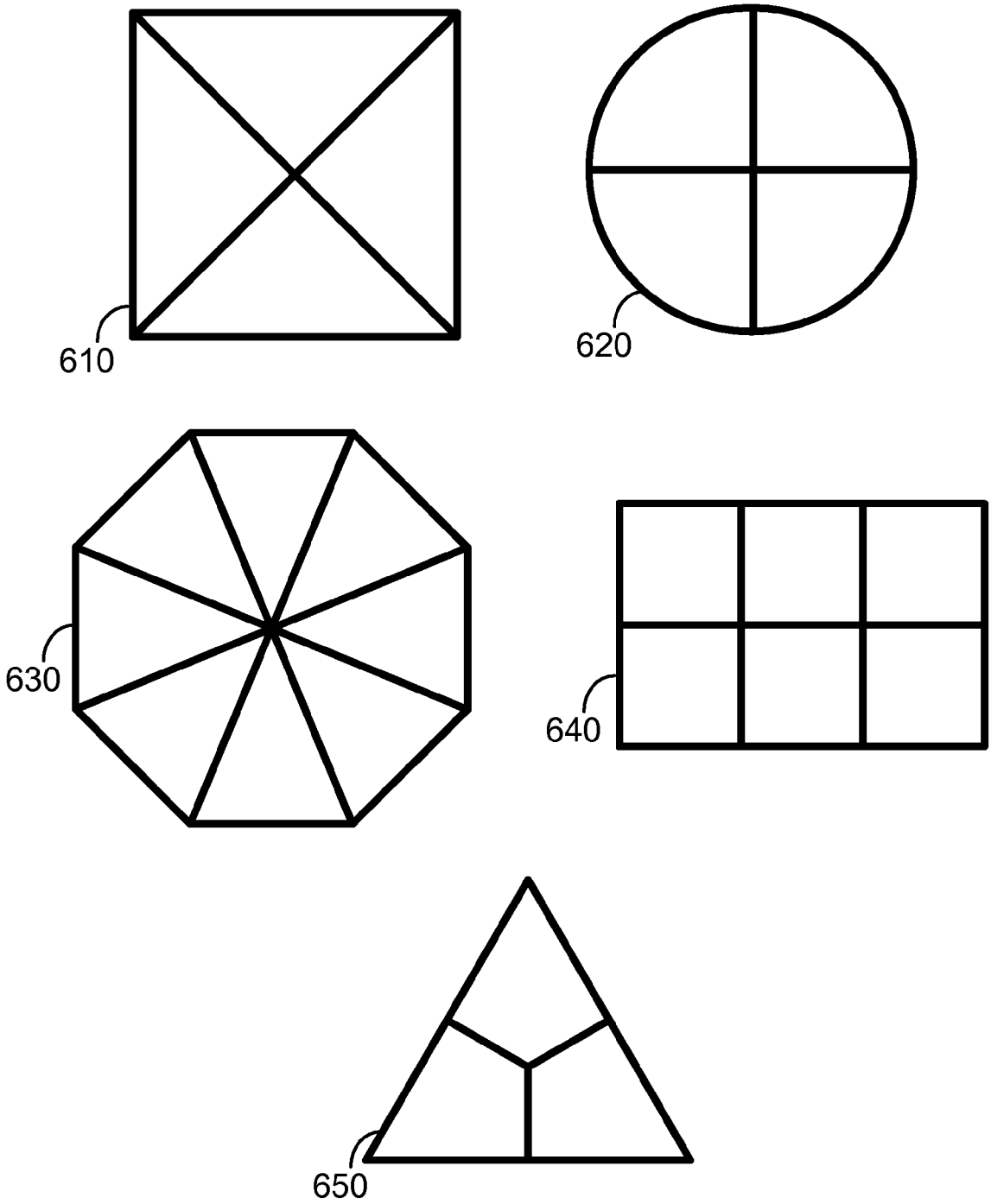
FIG. 6 illustrates plan views of exemplary alternate embodiments of the game frame apparatus of the present invention.

Referring to FIG. 5, the shape of the game frame (300) need not be limited to twice-bisected square or rectangular polyhedrons. Rather, many embodiments are possible whereby an arrangement (300A) of poles (510) and bars (500) define contiguous or substantially contiguous interior volume spaces that provide sufficient room for players to move and return balls over the top bar members of the game frame to other game boxes. Plan views of the top surface of exemplary embodiments are shown in FIG. 6, and comprise a square bisected at its vertices rather than midpoints (610), a twice-bisected circle (620), an octagon crossed with bars at its vertices (630), a rectangle defining a plurality of interior game spaces, such as six spaces (640), and a triangle (650) defining three interior game box spaces. In most cases, poles will attach to each vertex created by the intersection of the bar members and shapes shown on FIG. 6. The three-dimensional shapes formed by a hypothetical outside implied surfaces stretched along such top surfaces and poles could be a rectanguloid, cylinder, extruded octagon, extended rectanguloid, or extruded triangle, respectively.

In one embodiment of the game frame illustrated in FIG. 3, the length of the poles (310) is approximately seven feet, and each interior game box (A', B', C', and D') measures eight feet on each horizontal side, making the overall outer dimensions of the polyhedron defined by the game frame approximately 16 feet by 16 feet by seven feet high. While this embodiment provides for one play configuration, other dimensions may be easily provided for, such as if the poles (310) were decreased in length to allow an embodiment that was easier to play for short children.

In one embodiment, in a manner similar to camera tripod legs, the poles (310) may be shortened to a desired play length through a telescoping action provided by pole take-down elements (345). Those of skill in the art also may recognize that the dimensions of the interior game boxes may be varied from the exemplary eight feet by eight feet to accommodate available play space or differing players' ability.

In one embodiment, the ball (FIG. 4, 50) may be a rubber playground ball, or may be a typical play ball found in most toy sections of stores, such as balls with approximately ten-inch diameters and weighing approximately 95 grams. Alternatively volleyballs may be utilized as the game ball (50), and if the outside environment is being subjected to significant wind, a partially-deflated volleyball can offset the wind-induced shear forces, allowing for more enjoyable play. Generally, lighter balls provide for longer rallies and are better adapted to players of lower ability, while heavier balls provide more challenge and are more resistant to wind effects.

Figure 7:
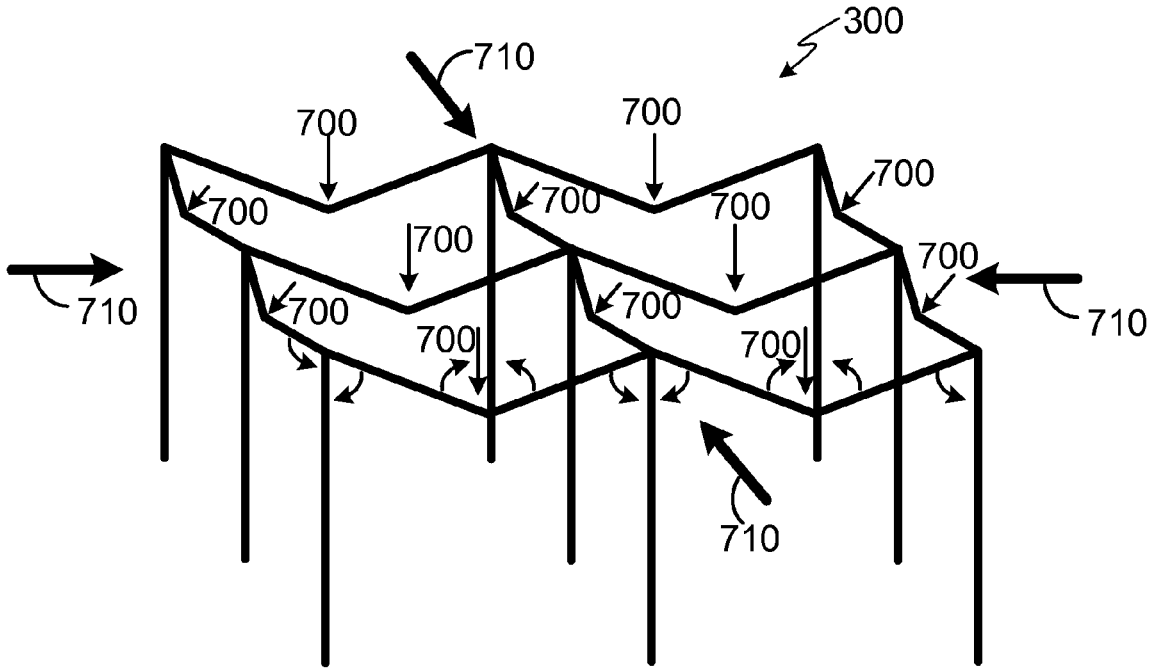
FIG. 7 illustrates an implementation of an apparatus of the present invention in the early stages of collapsing for transportation or storage.
Figure 8:
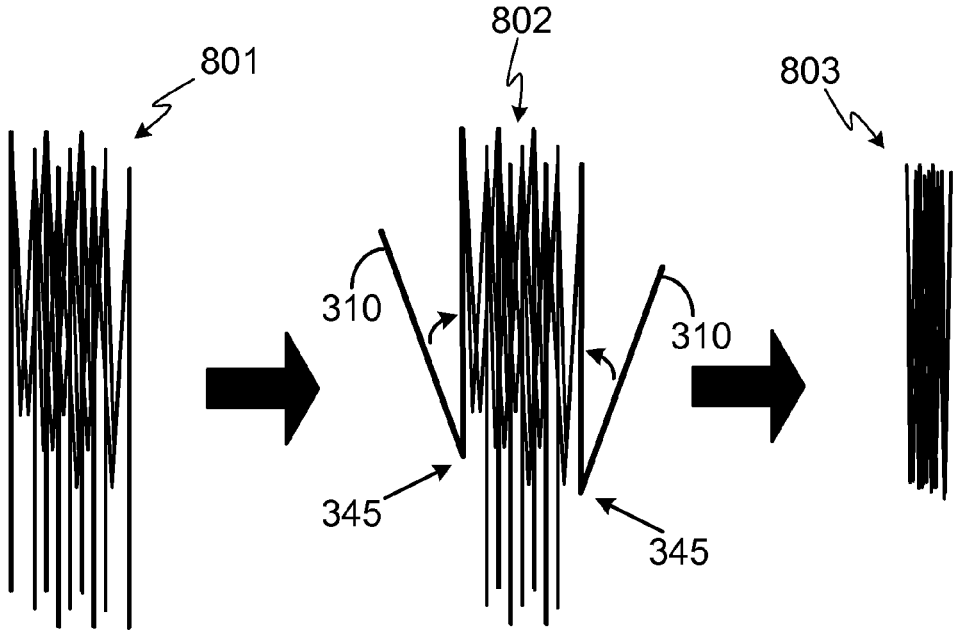
FIG. 8 illustrates one embodiment of additional disassembly of the poles of the present invention.
Figure 9:
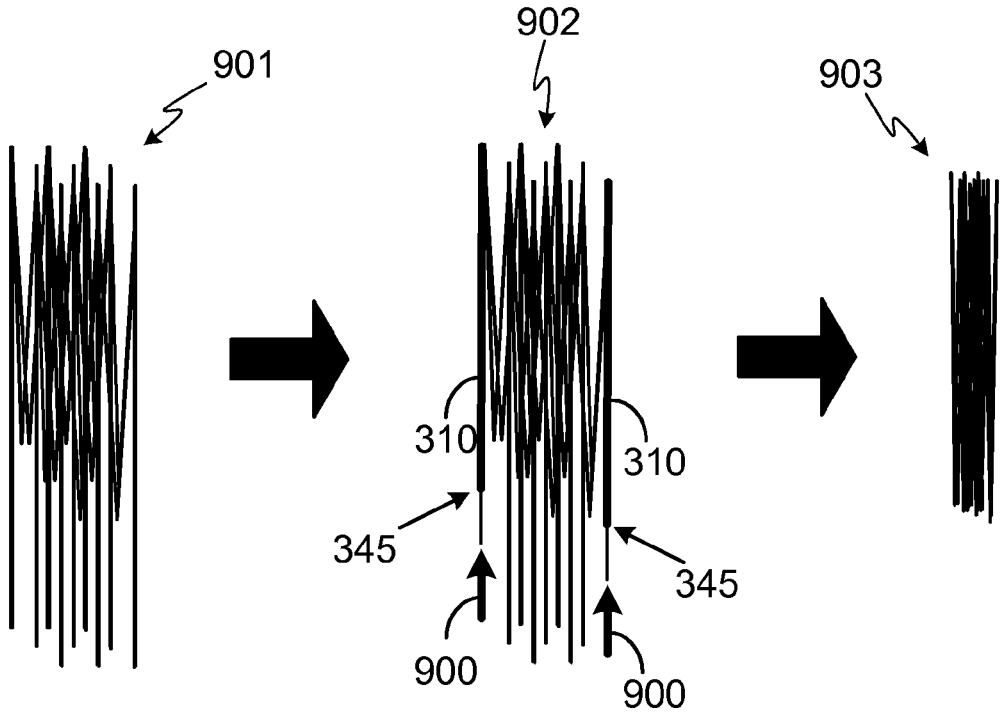
FIG. 9 illustrates an alternate embodiment of disassembly of the poles of the present invention; and, FIG. 10 illustrates another alternate embodiment disassembly of the poles of the present invention.
Figure 10:
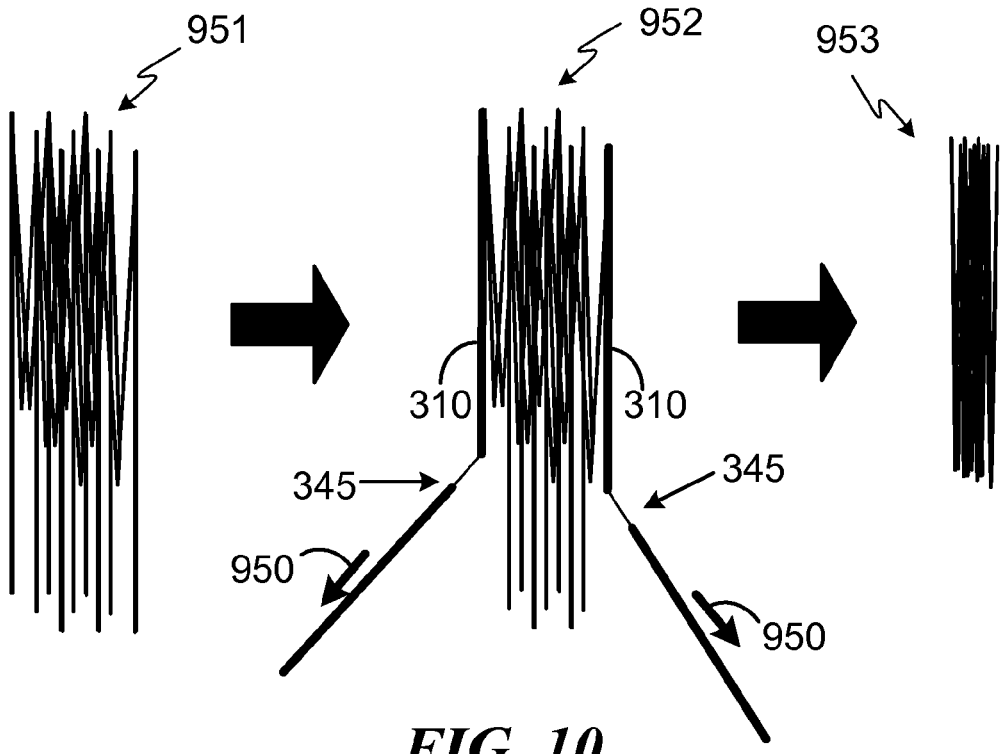

Turning now to FIGS. 7, 8, 9, and 10, the game frame apparatus (300) in FIG. 3 will now be shown in various stages of disassembly. In FIG. 7, downward force (700) is applied to the articulation points (340) so as to hingedly bias bar members (350) downward as shown in the arrows (700). As the bar members (350) rotate downward, the game frame (300) collapses inward in an accordion-like manner (710). Once the game frame (300) has collapsed inwardly, (FIGS. 8, 9, 10, items 801, 901 and 951, respectively) the bar members (350) and poles (310, 320, 330) come into close proximity in a bundle that eases transportation of the game frame. In one embodiment, to further shorten the bundle of rods and poles to improve portability, poles (shown as 310, but may also comprise poles 320 or 330) may be further folded (FIG. 8, 802) by rotating a bottom section of poles through a hinged joint (FIG. 8, 345). In an alternate embodiment (902) shown in FIG. 9, bottom sections of poles (310, 320, 330) slide in a telescoping manner (900) into larger upper chambers through an aperture to a larger outer top tube (345), which in outer deployed position could have been fixed by a clamp, rotating friction collar, set screw, or pin. In yet another embodiment (952) shown in FIG. 10, bottom sections of poles (310, 320, 330) detach from the top sections of the poles, and while held together with elastic or stretchable lines (345) are able to be folded vertically to join the bundle of bar members and poles (952), in a manner not unlike many disassemblable tent support poles in modern backpacking tents. As a result, the fully disassembled game frame (300) forms a dense and readily transportable bundle (803, 903, 953) that may be slid within a tote bag or carry box.

In an alternate embodiment, the articulation points (340) on the top surface of the game frame (300) do not hingedly connect; rather, bar members (350) separate a the articulation points (340) from a friction fit or pin-fastened connection, and then bar members (350) are free to rotate downward through hinged communication with corner junctions (360, 370, 380), and each pole (310, 320, 330) separates from the game frame with either two, three, or four bar members (350) hingedly attached.

Figure 4:
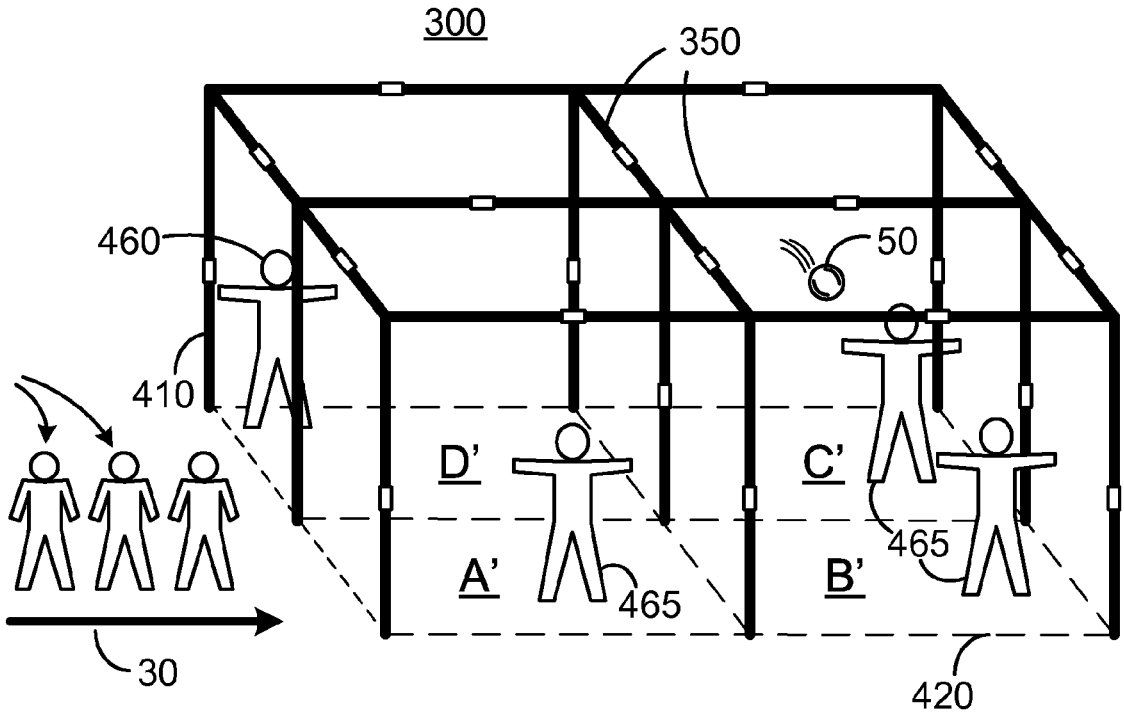
FIG. 4 illustrates one embodiment of the game frame apparatus of the present invention, with players shown engaged in a rally.

Referring to the apparatus shown in FIG. 4, the method of game play is now described. Initially, four players stand individually in play boxes (A', B', C', and D'). The player (460) that stands in the D' box (the serving box or volume) is identified as the serving player, and touches one foot to the outside corner pole (410). The rally begins with other non-serving players (460) standing in their respective play boxes and awaiting the serve. The serving player (460) either strikes or pushes the ball (50) with a volleyball-like hand motion up and out of the serving box so that the ball (50) lands in one of the other players' (465) boxes (A', B,' or C', or the "nonserving" boxes). Whatever player (465) receives the served ball must return it up and out of their box and down into another player's box. The rally continues until a player (460 or 465) allows the ball touch the bottom play surface (420) without successfully returning it to another player's box. That player is then "out" and must exit their box and return to the end of the queue (30) of people (60) waiting to enter box A'. The other players then rotate counter-clockwise until the interior play boxes (A', B', C', and D') are occupied by a player. Once a player rotates into play box D', that player becomes the new serving player and receives a point for every time a rally ends where another non-serving player (465) is "out."

In one embodiment of the method of the present invention, the serving player (460) should observe the following rules when serving: (a) one of the serving player's feet should be in contact with the outside corner pole (410), (b) the serving player (460) should annunciate that player's current score aloud before serving, and (c) the serving player (460) should serve the ball into another player's (465) box (A', B,' or C') without the ball (50) touching any of the game frame's horizontal bar members (or barriers) as shown by the two exemplary bar members (350) in FIG. 4. If the serving player (460) fails to observe the aforementioned rules, the serving player is considered "out" and must leave the serving player box (D'). Rotation and new player entry then occurs as described above. After being returned by at least one non-serving player (465), the ball may strike a horizontal bar member (such as 350) and the ball will remain in play. The first player to receive ten points wins the game, and a new game may then be started.

Although an exemplary, preferred embodiment of this invention has been described using preferred commercial products, it will be readily understood by those skilled in the art that modifications of the methods and apparatuses described, as well as substitution of equivalent commercially available products may be made without departure from the spirit and scope of the invention claimed.

What is claimed is:

1. A method for playing a game by a plurality of players, the method comprising:

providing an apparatus;

providing a projectile;

positioning the apparatus upon a playing surface, the apparatus including:

first and second sets of poles, each of said first and second poles having first and second opposite ends;

providing means for adjusting the pole between a full length position and a shortened length position; and providing means for connecting the second end of each of said poles in the first set of poles to one of the ends of at least two of said poles in the second set of poles;

positioning each of said poles in the first set in a vertical orientation with the first end thereof resting on the playing surface; positioning each of said poles in the second set in a horizontal orientation; wherein:

each of said poles in the first set of poles is in a perpendicular orientation with respect to the poles in the second set of poles;

(i) extending each of said poles in the first and second sets of poles in the full length position; wherein:

the first and second set of poles forming at least four interior playboxes of substantially equal volume;

defining the four interior playboxes by:

(i) a plane extending from each said pole in the first set of poles to intersect with each adjacent said pole in the first set of poles;

(ii) a plane extending from each pole in the second set of poles to intersect with, and be perpendicular to the playing surface; and (iii) a plane extending from each said pole in the second set of poles to intersect with another said pole in the second set of poles that is parallel thereto; and (iv) the playing surface;

wherein the plurality of players play the game upon the playing surface within the apparatus by:

(a) placing a player in each of the at least four playboxes upon the playing surface, wherein: each said playbox is contiguous and substantially equal in size to all other said playboxes; a barrier is positioned at the top of and between any two contiguous said playboxes;

(b) a first player of one of said plurality of players, projecting said projectile by either striking or pushing up and out from the player's playbox down into one of a second player of the plurality of player's playbox over the barrier there between;

(c) the second player of the plurality of player's projecting the projectile up and out from the player's play box and down into any other of said play boxes over the barrier there between;

(d) repeating (b) and (c), for respective said plurality of players and said play boxes, until a first condition occurs in which the projectile contacts the playing surface;

(e) the player who allows the projectile to contact the playing surface is out, (f) the remaining players of the plurality of players rotate position and a new player enters one of said play boxes;

(g) the first player to receive a designated point value wins the game and a new game may then be started.

2. The method as defined in claim 1, wherein each said pole comprises a material selected from the group consisting of aluminum, steel, PVC, polystyrene, vinyl, polyethylene, nylon, and combinations thereof.

3. The method as defined in claim 1, wherein each said substantially equal volume of the four interior play boxes has a shape selected from the group consisting of a substantially rectangular parallelepiped shape and a substantially cuboid shape.

4. The method as defined in claim 1, wherein the means for adjusting the pole between the full and shortened length positions thereof comprises means for disassembling the pole.

5. The method as defined in claim 1, wherein means for adjusting comprises means for telescoping an inner elongate member within an outer elongate member.

6. The method as defined in claim 1, wherein each said means for adjusting and each said means for connecting articulate such that each said pole in the game apparatus is substantially parallel to each other said pole.

7. The method as defined in claim 1, wherein each said means for adjusting and each said means for connecting articulate such that the poles can be moved into:

an operative position in which each said pole is substantially normal to at least one other said pole; and a collapsed position in which each said pole is substantially parallel to each other said pole.

8. The method as defined in claim 1, wherein each said interior play box has a width of not less than four feet and a height of not less than six feet.

9. The method as defined in claim 1, wherein (b) and (c) are repeated until a second condition occurs in which the projectile is projected by one of said plurality of players outside the player box thereof without: entering another said play box; or being projected over the barrier between said play box thereof and the another said play box.

10. The method as defined in claim 1, further comprising the step of one of said play boxes is designated as a serving play box; and a player of the plurality of players in the serving play box is designed as a server.

11. The method as defined in claim 10, further comprising the step of a foot of the server is required to be at the periphery of the respective play box opposite one said play box into which the server projects the projectile.

12. The method as defined in claim 1, further comprising the step of removing from the play box thereof the player last projecting the projectile upon the occurrence of the first or second condition, and then continuing the playing of the game by the remaining said players without the removed said player.

* * * * *